US005234056A

United States Patent [19]

Bodine, deceased et al.

[11] Patent Number: 5,234,056

[45] Date of Patent: Aug. 10, 1993

[54] SONIC METHOD AND APPARATUS FOR FREEING A STUCK DRILL STRING

[75] Inventors: Albert G. Bodine, deceased, late of Beverly Hills; Lucy E. Young, executor, Pasadena, both of Calif.

[73] Assignee: Tri-State Oil Tools, Inc., Calif.

[21] Appl. No.: 565,363

[22] Filed: Aug. 10, 1990

[51] Int. Cl.[5] ..... E21B 31/00

[52] U.S. Cl. ..... 166/301; 166/177; 166/178

[58] Field of Search ..... 166/301, 104, 177, 178

[56] References Cited

U.S. PATENT DOCUMENTS

| | | | |
|---|---|---|---|
| 3,152,642 | 10/1964 | Bodine | 166/301 |
| 3,155,163 | 11/1964 | Bodine | 166/301 |
| 3,168,140 | 2/1965 | Bodine | 166/301 |
| 3,500,908 | 3/1970 | Barler | 166/301 |
| 4,184,559 | 1/1980 | Rass | 56/DIG. 15 X |
| 4,429,743 | 2/1984 | Bodine | 166/177 |
| 4,667,742 | 3/1987 | Bodine | 166/301 |

*Primary Examiner*—Terry Lee Melius
*Attorney, Agent, or Firm*—Edward A. Sokolski

[57] ABSTRACT

A mechanical oscillator which employs unbalanced rotors is coupled to the top end of a drill string which has become stuck in a bore hole. The rotors are driven at a rotation speed such as to generate high level energy at a sonic frequency, this energy being coupled to the drill string. A low impedance load for the oscillator and the top of the drill string is created by supporting the oscillator from the support structure, which may comprise a derrick or the like, by means of a highly elastic support which may include elastomeric stretch bands, springs or other elastomeric support having a linear constant spring rate. In addition, hydraulic cylinders which may be servo driven are used to keep the drive motors for the oscillators in one place as the oscillator structure vibrates. The oscillators are driven at a high energy level to effect high displacement of the top of the drill string which presents a low impedance load to this energy in view of the highly elastic support provided. The drill string acts as an acoustic lever which translates the high displacement at the top of the string into a very high force at the point along the drill string which is stuck in the bore hole where a high impedance load is presented. The frequency of the oscillator may be adjusted to provide resonant vibration of the drill string to effect a reflected wave at the stuck point with a resultant increased cyclic force at this point.

12 Claims, 5 Drawing Sheets

SONIC METHOD AND APPARATUS FOR FREEING A STUCK DRILL STRING

BACKGROUND OF THE INVENTION

1. Field of the Invention

This invention relates to oil well drilling and more particularly to a method and apparatus employing sonic energy for freeing a section of drill string which has become stuck in a bore hole.

2. Description of the Related Art

An ongoing problem in the drilling of oil wells is the sticking of the drill string against the bore hole wall. This problem becomes accentuated where the sticking occurs at a great distance below the surface where the freeing of the string becomes increasingly difficult. Methods and apparatus have been devised in the prior art for employing sonic energy which is fed to the stuck section of the drill pipe to effect its freeing. Such prior art methods and apparatus generally employ mechanical oscillators which are operated at a frequency such as to effect resonant standing wave vibration of the drill string. In U.S. Pat. No. 3,168,140 issued Feb. 2, 1985 to Albert G. Bodine and U.S. Pat. No. 3,155,163 issued Nov. 3, 1964 to Albert G. Bodine, methods and apparatus are described for freeing a drill string in which sonic energy is applied to the top of the drill string to effect resonant standing wave vibration of the string which vibrational energy is fed down the string to the point of sticking. In U.S. Pat. No. 4,667,742 issued May 26, 1987 to Albert G. Bodine, a method and apparatus is described in which the oscillator is lowered down the bore hole and connected to the down hole stuck pipe section and the string then resonantly vibrated to effect the desired freeing action. While some effort is made in all of these prior art devices to vibrationally isolate the drill string from the suspension hardware, either in the form of springs, or by adjusting the frequency of vibration so that a node of the resonant wave appears at the point of connection to the support members, there is no suggestion in these prior art patents of suspending the top of the drill string with a highly elastic support so as to make for very low impedance to the vibrational energy generated by the oscillator at this point. Further, there is no disclosure in such prior art directed to utilizing the drill string as an acoustic lever with the top end of the string being driven with a very high displacement and this high displacement being reflected at the sticking point as a high force vibration.

SUMMARY OF THE INVENTION

The basic feature of the present invention is the utilization of the stuck drill string as an acoustic lever to multiply the cyclic output of the mechanical oscillator employed so as to develop a very high force down hole where the string is stuck in the bore hole. The principles of acoustical leverage are aptly described on pages 418–422 of A Textbook of Sound by A. W. Wood, published in 1957 by G. Bell and Sons Ltd., London, England. As pointed out in this treatise, there is a close analogy between a static lever and an acoustic lever such that a small vibratory effort at one end of the acoustic lever exerted over a long distance(lever arm) will produce a large force acting over a short distance. In implementing such operation in the apparatus and method of the present invention, a low impedance condition is created at the top end of the drill string where the sonic energy is coupled thereto from a mechanical oscillator formed by unbalanced rotors which are rotatably driven to generate such energy. This low impedance condition is achieved by supporting the oscillator structure on a highly elastic support system which has constant linear properties.

In the preferred embodiment such support system is formed by elastomeric bands through which the oscillator structure and the drill string to which the oscillator is connected are suspended from a lift system which may comprise a derrick. The drill string is thus acoustically free at its top end, presenting a low impedance to the acoustical output of the oscillator. The rotors are driven by a high power motor to effect high vibratory displacement of the top end of the drill string(typically of the order of two inches). The frequency of the oscillator is adjusted to provide a resonant standing wave vibration of the drill string with a node of the velocity wave(antinode of the force wave) at the point where the string is stuck and a velocity antinode at the free top end of the string. The elastic suspension system is designed so that it is as linear in response as possible so as to minimize the generation of harmonics or overtones in the vibration system and the resultant energy losses engendered by such harmonics. The drill string thus operates in the nature of a lever, the "handle" of which moves freely with high displacement to provide amplified force by virtue of the lever action down hole at the portion of the string stuck in the bore hole.

In one embodiment of the invention, means which may comprise a hydraulic servo are employed to keep the oscillator drive motors fixed in position and thus isolated from the high displacement vibration of the oscillator rotors.

In another embodiment of the invention, a second column made of twisted steel strand cable is inserted within the drill string, the strands of the cable being adapted to slip on each other when bending of the cable occurs. This inner cable by virtue of the friction between the coacting strands thereof operates to damp lateral vibrations which may be induced due to misalignment of the string or other unbalances which may be present.

In another aspect of the invention, a portion of the longitudinal energy generated in the drill string is converted to lateral vibratory energy which can be highly useful in freeing the string. This end result is achieved by releasing the pull of the derrick on the string allowing the weight of the string and the equipment attached thereto to provide a compressional force on the stuck portions of the string. This tends to engender a lateral vibrational mode to effect a torsional force on the string at its point of lodgement which is highly effective in freeing the string.

It is therefore an object of the invention to facilitate the freeing of drill strings and the like which may become stuck in a bore hole;

It is a further object of this invention to provide an acoustic lever for multiplying sonic energy generated on the free end of a drill string to a high force level at a downhole point on the string which is stuck in a borehole;

Other objects of the invention will become apparent from the following description taken in connection with the accompanying drawings.

DETAILED DESCRIPTION OF THE INVENTION

Figure 1:
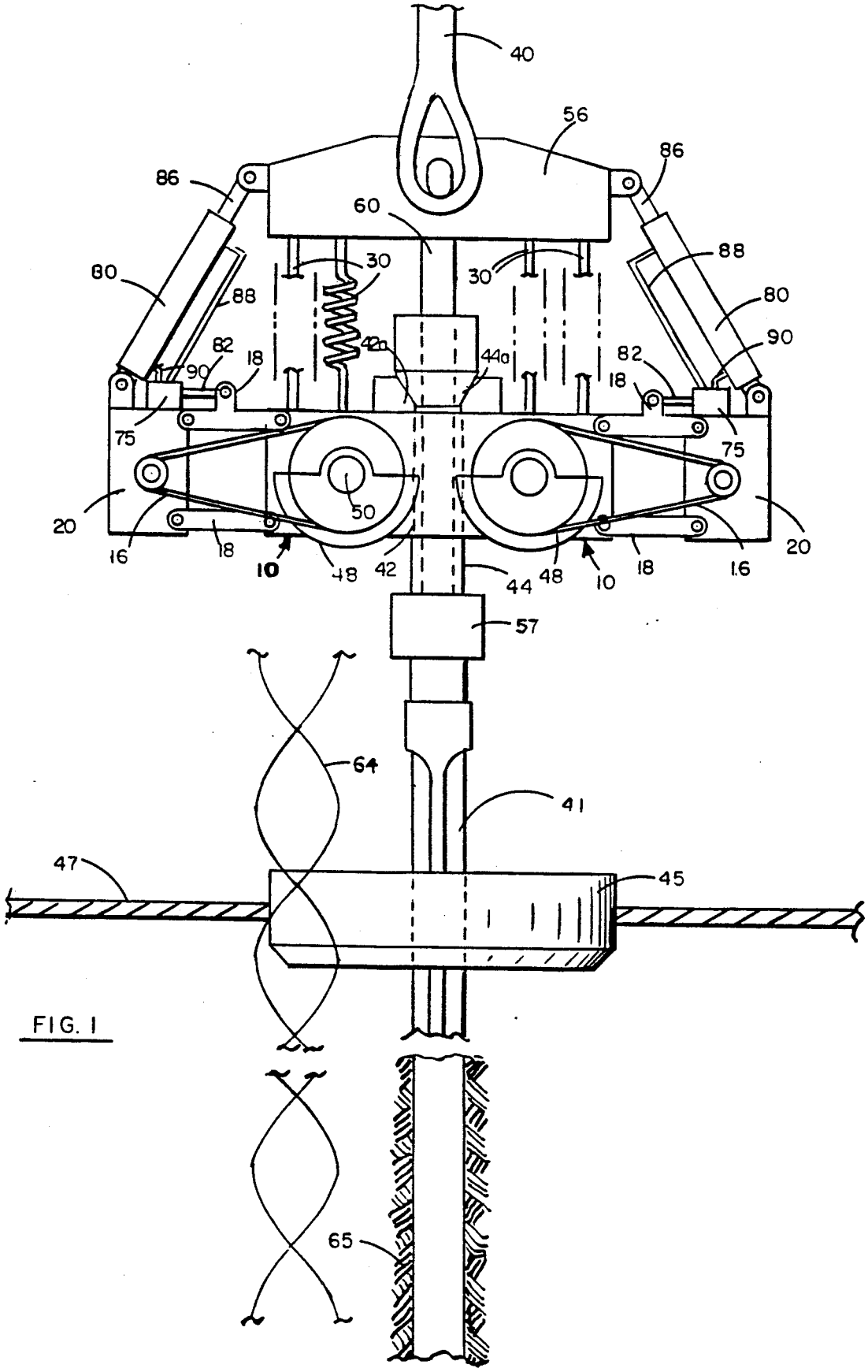
FIG. 1 is a schematic representation of the system of the invention.

Referring now to FIG. 1, the system of the invention is schematically illustrated. Pull beam 56 is suspended from a derrick through link 40. Vibrating beam 42 is suspended from pull beam 56 by means of "spring" members 30 which in the preferred embodiment are formed by a plurality of elastomeric bands which provide a "soft" connection between the two beams. These bands may be fabricated of a material such as woven rubber strands covered by cross sectional braided yarn. Typically such bands have a diameter of 13/16" and a ring diameter of 20". Bands of this type are termed "shock rings" and are commercially available from Thomas Taylor and Sons, Hudson, Mass. The bands should have a highly linear spring rate with a large vibration stroke which is typically two inches or more in the preferred embodiment. A pair of orbiting mass oscillators 10 having semi-circular rotors 48 are mounted on vibrating beam 42 and are rotatably driven in opposite directions by means of associated motors 20 through drive belts 16. Motors 20 are typically high power hydraulic motors. The rotors are phased in the preferred embodiment to generate longitudinal vibrational energy, i.e. along the longitudinal axis of vibrating stem 44, transverse vibrational energy being cancelled out. To accomplish this end result, the rotors are phased as shown in the drawing so that when they are ninety degrees from where shown, one rotor will be generating an outward force while the other rotor will be generating an equal and opposite inward force.

Motors 20 are kept centered during the high stroke vibration of vibrating beam 42 by means of a hydraulic servo system which employs a pair of centering cylinders 80, the drive shafts 86 of which are connected to support or pull beam 56, the opposite ends of the cylinders being connected to the casing of motors 20. Link arm 18 is pivotally supported on the casing of motor 20 on one end and on vibrating beam 42 on the other end. With pivotal motion of the link arm, piston rod 82 is driven in and out of valve body 75 to cause the valve body to deliver hydraulic pressure fluid in response to such motion to either lines 88 or 90 to effect the desired centering action. The details of the operation of this hydraulic servo will be described in detail further on in the specification. If so desired, a simple pair of cylinders which operate without a servo system may be employed, these cylinders having their shafts coated with a material such as a suitable polymer material to provide viscous damping action to the vibratory energy which damping tends to keep the motors centered.

Stem 44 is suspended from vibrating beam 42 by virtue of flanged end 44A which is supported on mating flange 42A. A swivel 57 is provided between stem 44 and the drill string 41, the string fitting through a conventional rotary table 45 mounted on derrick floor 47.

In operation, rotors 48 are driven in opposite directions by means of motors 20 to generate vibratory energy in drill string 41 at a sonic frequency which is typically about 5-10 Hertz. This frequency is adjusted to produce standing wave vibration of the drill string with a longitudinal mode of vibration; (as already noted, the lateral vibrations are cancelled out). The frequency is adjusted by changing the speed of the motors and thus the rotors so that the standing waves 64 which are generated have an antinode of vibration at the bottom of stem 44 and a node of vibration at the point 65 at which the string is stuck in the bore hole. Thus, the displacement of the vibration is at its highest point in the vicinity of the oscillator and its lowest point at the stuck point, this providing the desired force lever action, with optimum force being developed at the stuck point.

An insert column 60 which is attached at its top end to pull beam 56 and at its bottom end to drill stem 44 may be employed to damp out lateral parasitic vibrations which may be generated due to misalignments in the drill string or unbalances in the mechanism. This column may be made of twisted steel strand cable, the strands of the cable slipping on each other when bending of the cable occurs. Thus with bending of the main drill string, mutual bending vibration of cable 60 occurs. This mutual bending vibration causes slippage between the strands which are also in the contact regions between the cable and the drill string with consequent mutual slipping like a leaf spring. The inter layer slipping involves friction which tends to damp the unwanted lateral vibrational energy. This frictional damping can be enhanced by applying non-hardening adhesive or mastic to the surfaces of cable 60 which contact the inner surfaces of the stem 44. The intimacy of this contact can be enhanced by bending cable 60 at several points along its length.

Figure 2:
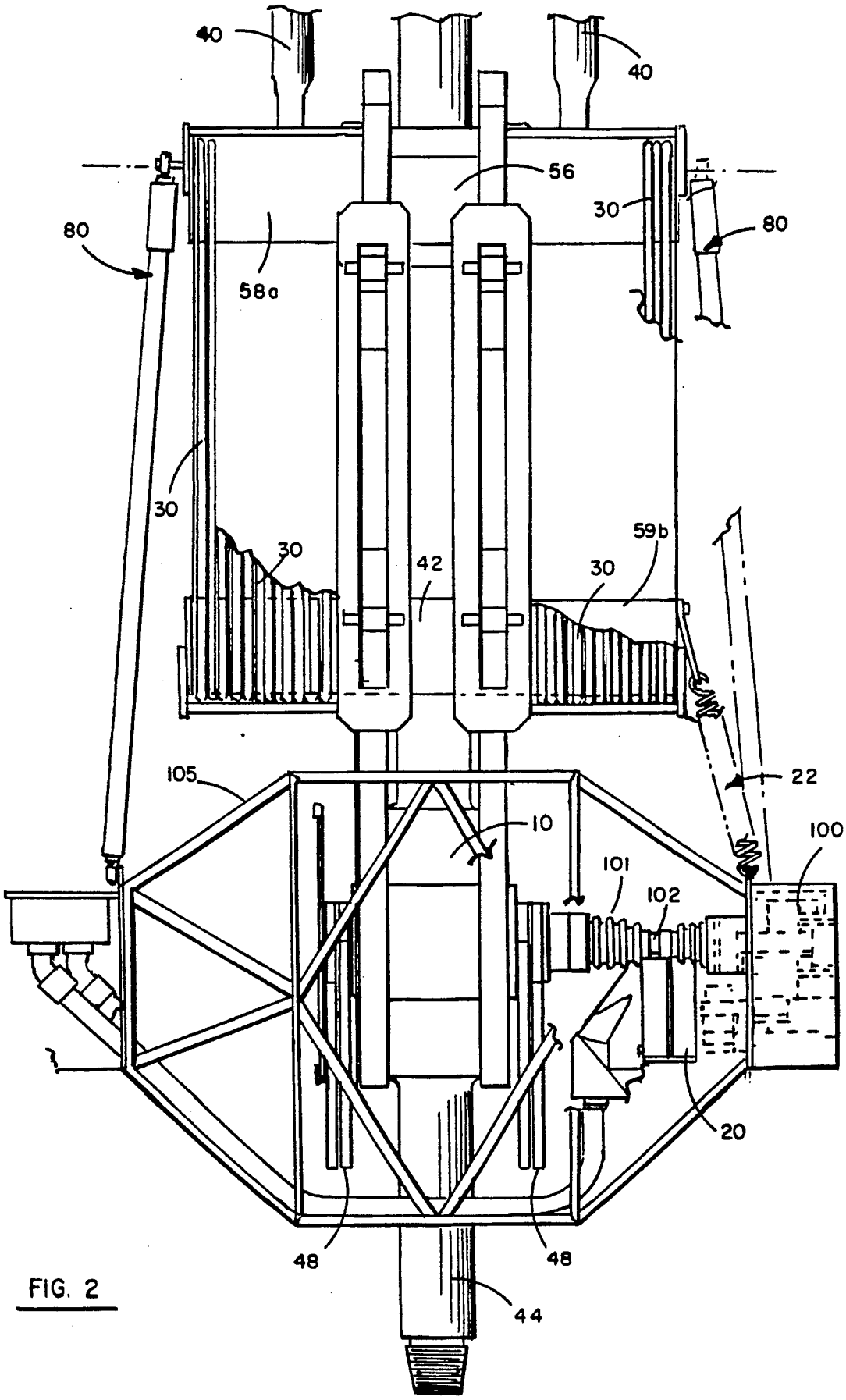
FIG. 2 is a front elevational view of a preferred embodiment of the invention.
Figure 4:
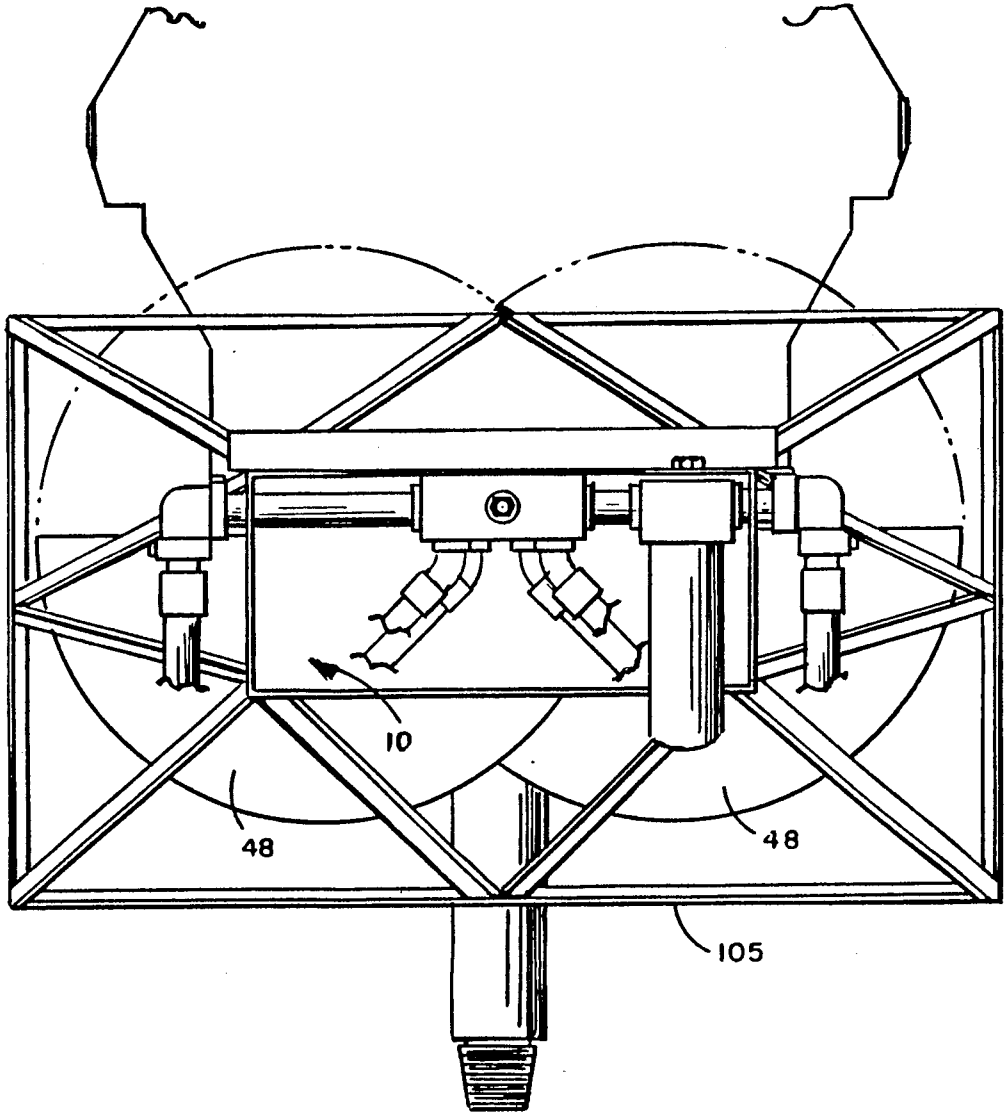
FIG. 4 is a rear elevational view of the oscillator of the preferred embodiment.
Figure 3:
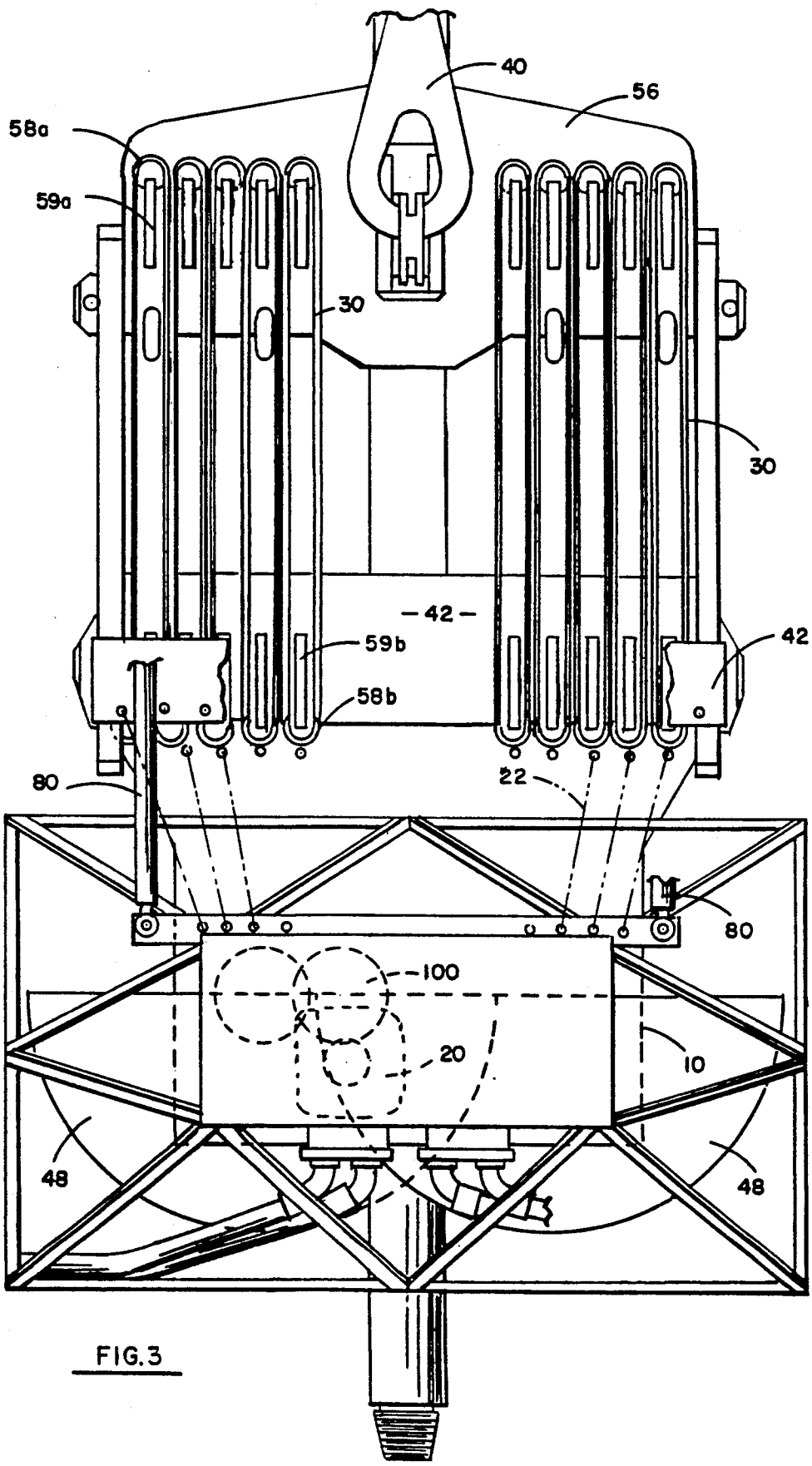
FIG. 3 is a side elevational view of the preferred embodiment.

Referring now to FIGS. 2-4, a preferred embodiment of the invention is illustrated. Like numerals have been used to identify corresponding components schematically illustrated in FIG. 1.

Pull beam 56 is supported from a derrick(not shown) through a pair of derrick links 40. A pair of vibrating beams 42 are resiliently supported from pull beam 56 by means of a plurality of highly elastic stretch bands 30 which may be fabricated of a material such as woven rubber strands and typically have a ring diameter of 20" and a cross sectional diameter of 3/16". Bands 30 are capable of considerable extension and in operation typically extend about thirty inches when a pull of four hundred thousand pounds is applied through derrick links 40. In an operative embodiment, about 360 bands are employed, such bands being supported on slats **59*a* and 59*b* which are carried in slots 58*a* and 58*b* formed in the pull and vibrating beams respectively. Bands 30 provide a "soft" connection between beams 42 and 56 effectively vibrationally isolating the pull beam 56** from the vibrating beams.

Figure 2A:
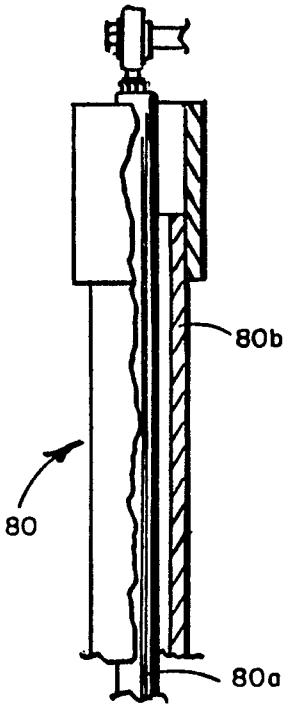
FIG. 2A is a fragmentary elevational view of the damping cylinder of the preferred embodiment.

A pair of hydraulic motors 20 which typically, for example, may be series F-11 motors manufactured by Volvo Hydraulics, Sweden are each employed to rotatably drive one of rotors 48 of paired oscillators 10. The motors are coupled to the rotors through gear trains 100 via drive shafts 101 and U-joints 102. As described in connection with FIG. 1 the rotors are driven in opposite directions and phased to generate vibratory energy along the longitudinal axis of shaft 44 with lateral vibrations effectively being cancelled out. The motors are supported on support cage 105. Support cage in turn is supported from pull beam 56 by means of springs 22 and viscous damped cylinders 80, these cylinders having a loosely fitted shaft 80*a* supported in cylinder housing 80*b*, as shown in FIG. 2A. The cylinder housing is filled with a viscous damping fluid such as a polymer butene. The support cage 105 is thus vibrationally isolated from the vibrational energy generated by the oscillator and coupled to the inner drive shafts of the motor. In this manner, the motor is kept "floating" (with the help of U-joints 102) so that it does not follow the high displacement vibration of the oscillator. As described in connection with FIG. 1 and as further to be described in connection with FIG. 5, a hydraulic servo system may also be employed to achieve this end result.

In operation, the rotors 48 of oscillators 10 are driven in opposite directions to produce longitudinal resonant vibration of stem 44 and the drill string to which stem 44 is connected, as described in connection with FIG. 1. The speed of rotation of the drive motors 20 is adjusted to produce a resonant mode of vibration which provides an antinode of the standing wave at the oscillator housing and a node of such standing wave at the point at which the drill string is stuck in the bore hole. This results in a lever action with the high displacement at the oscillator resulting in a high force at the point of sticking. The highly elastic support bands 30 enable a linear vibratory displacement of the vibrating beam 42 on which the oscillators are mounted which typically is 1–2 inches. Such linear displacement, which is enabled by the elastic support bands, avoids the generation of undesirable harmonics in the vibration system with its resultant wasted energy and affords high "Q" efficient operation of the system.

In practicing the method of the invention, a portion of the longitudinal vibration cycle can be converted into lateral vibrations to improve the action in freeing the drill string. This end result can be accomplished by making a portion of the drill string buckle somewhat This can be achieved by locating a stress or force antinode of the standing wave in a region of the drill string which is bent slightly due to hole deviation. The longitudinal push-pull cyclic force tends to enhance the bending as the result of a toggle effect which tends to buckle the pipe in the nature of an over-loaded compression column. This end result can be monitored by selecting an overtone vibration frequency at which a moderate amount of lateral vibration travels up the string which can be observed as lateral vibration at the oscillator. If the string is differentially stuck such as by the hydrostatic pressure of the mud column holding the string laterally against the bore hole wall, the superposition of lateral vibrational energy can shake the pipe away from the wall and allow the mud liquid to flow therebetween and free up the string.

Another technique which may be employed is to reduce the upward pull of the derrick so that the drill string starts to buckle sidewise under the compressional force thus induced, thus developing lateral vibrational energy down hole from the longitudinal energy.

A further technique for engendering lateral vibration down hole is to introduce torquing force to the drill string while it is being longitudinally vibrated. This produces a diagonal vibrational component with this component combining with the longitudinal force to provide a net force vector which is tilted or slopes relative to the longitudinal axis of the string. The torquing force is best provided to the drill string by utilizing the conventional rotary drilling system available on the rig such as a standard rotary table which turns a Kelly bar. This avoids the need for turning the entire mechanism.

As explained in connection with FIG. 1, a twisted wire cable 60 may be installed within the drill string to damp out parasitic lateral vibrations resuling from misalignment of the system.

Figure 5:
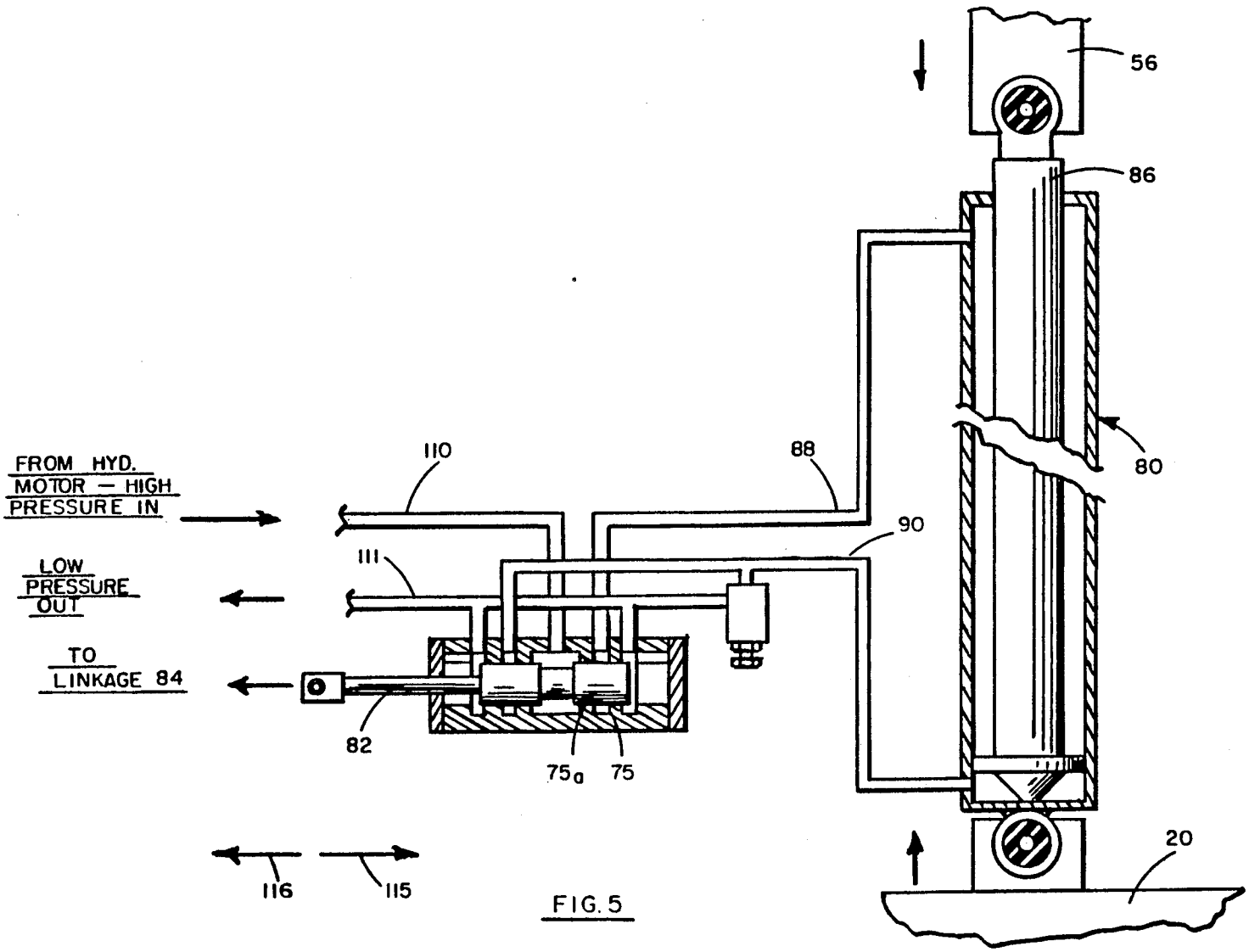
FIG. 5 is a schematic illustration showing a hydraulic servo system which may be used to keep the oscillator drive motor in place.

Referring now to FIG. 5, a hydraulic servo system which may be used to keep the motors in place with the vibrational motion of the oscillators is shown. This servo system is schematicallly illustrated in FIG. 1.

Hydraulic positioning valve 75 has a piston rod 82 extending therefrom which is pivotally connected to link arm 18 which in turn is connected between the oscillator and motor housings(see FIG. 1). Hydraulic cylinder 80 is pivotally attached at its botttom end to the housing of motor 20 while cylinder piston 86 is pivotally attached to pull bar 56. Attached to piston rod 82 is valve assembly 75*a* of hydraulic positioning valve 75. Fluid line 90 is connected to one end of cylinder 80 while line 88 is connected to the opposite end thereof. Hydraulic fluid is pumped into positioning valve 75 from a hydraulic motor(not shown) through line 110 with a return to the hydraulic motor being provided by means of line 111. When the drive motor starts to fall below a predetermined "neutral" position, the housing of positioning valve 75, which as shown in FIG. 1 is supported on the motor housing, moves in the direction indicated by arrow 115. Valve assembly 75*a* will resultantly move to the left in the positioning valve casing. This will open the fluid path between the valve casing and line 88, providing hydraulic pressure to the top of cylinder 80, thus causing the motor to be driven back to its initial position. Conversely should the motor move above its predetermined neutral position, the valve casing will move in the direction indicated by arrow 116 so as to cause the valving of fluid pressure through line 90 so as to drive the motor downwardly. The valve provides rapid response to any changes in motor position from neutral such that incipient changes in position are sensed and immediately compensated for so as to effectively maintain the motor in its predetermined neutral position at all times and thus effectively isolated from the vibrational displacement of the oscillator.

While the invention has been described and illustrated in detail, it is to be clearly understood that this is to be taken by way of illustration and example only and not by way of limitation, the spirit and scope of the invention being limited only by the terms of the following claims.

It is claimed:

1. A method for freeing a drill string stuck in a borehole at a down hole point thereof comprising the steps of:

resiliently suspending a mechanical oscillator from a support structure on an elastomeric support having a linear constant spring rate, coupling said oscillator to the top end of the drill string, the elastomeric support creating a low impedance condition for vibratory energy at said drill string top end, driving said oscillator to generate high level sonic vibratory energy in a longitudinal vibration mode so as to effect high longitudinal vibratory displacement of the top end of the drill string, the drill string acting as an acoustic lever which translates the high vibrational displacement at the top end of the drill string into a high vibrational force at the point where the drill string is stuck in the bore hole, thereby facilitating the freeing of the drill string.

2. The method of claim 1 wherein said mechanical oscillator is suspended from the support structure by means of a plurality of elastomeric bands.

3. The method of claim 1 and further including the step of adjusting the the frequency of said oscillator to provide a resonant standing wave vibration of the drill string with a velocity antinode of said standing wave appearing at the top end of the drill string and a velocity node of said standing wave appearing at the point where the drill string is stuck in the bore hole.

4. The method of claim 1 and further including the step of releasing the holding action of the support structure to provide a compressional force effected by the weight of the support structure and the drill string to provide a compressional force on the drill string at the down hole point where the string is stuck, thereby engendering a lateral mode of vibration which combines with the longitudinal mode of vibration to form a torsional vibrational force.

5. The method of claim 1 and further including the step of adjusting the frequency of the oscillator so that a vibratory standing wave appears along the drill string with a force antinode(displacement node) of said wave appears in a region of the drill string which is bent due to hole deviation, thereby tending to buckle the string in this region to effect lateral vibration thereof in addition to the longitudinal vibration.

6. The method of claim 1 and further including the step of applying a torquing force to the drill string by means of a rotary table, thereby engendering lateral vibration of the string.

7. The method of claim 1 and further includding the step of installing a twisted wire cable within said drill string, the top end of said cable being attached to said support structure and the bottom end thereof to said drill string, the strands of said cable slipping against each other with mutual bending of the drill string and cable thereby damping lateral vibrational energy.

8. A system for use in freeing a drill string stuck in a bore hole at a down hole point thereof comprising:

a mechanical oscillator, motor means for driving said oscillator to generate sonic vibrational energy, means for coupling said energy to the top end of said drill string to effect vibration thereof at a sonic frequency, support means, and elastomeric means having a linear constant spring rate for resiliently suspending said oscillator from said support means, said elastomeric means engendering a low impedance for said oscillator and the top end of the drill string at the frequency of vibration, the vibrational energy being at a level such as to effect high vibrational displacement of the top end of the drill string, the drill string acting as an acoustic lever which translates the high vibrational displacement at the top end of the drill string into a high vibrational force at the point where the drill string is stuck in the bore hole, thereby facilitating the freeing of the string.

9. The system of claim 8 and further including means for maintaining the motor means fixed in position and isolated from the high displacement vibration of the oscillator.

10. The system of claim 9 wherein the means for maintaining the motor means fixed in position comprises a hydraulic servo.

11. The system of claim 8 wherein said elastomeric support means comprises a plurality of elastomeric bands on which the oscillator is suspended from said support means.

12. The system of claim 8 and further including a twisted wire cable installed within the drill string and attached at one end thereof to said support means and at the other end thereof to said drill string, the strands of said cable slipping against each other with mutual bending of the drill string and cable, thereby damping parasitic lateral vibrational energy, support means and said oscillator.

* * * * *